United States Patent [19]

Chang

[11] Patent Number: 4,947,524

[45] Date of Patent: Aug. 14, 1990

[54] RESILIENT SHEET-STEEL PAPER CLIP

[76] Inventor: Chin-Fu Chang, No. 166-1, Chang Nan Road, Changhua, Taiwan

[21] Appl. No.: 467,173

[22] Filed: Jan. 19, 1990

[51] Int. Cl.[5] ..... B42F 1/02

[52] U.S. Cl. ..... 24/67.9; 24/67.3; 24/563

[58] Field of Search ..... 24/67.9, 67.3, 67 R, 24/545, 563

[56] References Cited

U.S. PATENT DOCUMENTS

| | | | |
|---|---|---|---|
| D. 145,602 | 9/1946 | Jacobson | 24/563 |
| 966,325 | 8/1910 | Gilbert | 24/563 |
| 3,348,272 | 10/1967 | Germani | 24/563 |
| 4,055,874 | 11/1977 | Brown | 24/67.9 |
| 4,706,342 | 11/1987 | Yu | 24/67.9 |

FOREIGN PATENT DOCUMENTS

| | | | |
|---|---|---|---|
| 978127 | 4/1951 | France | 24/67.9 |

*Primary Examiner*—Victor N. Sakran
*Attorney, Agent, or Firm*—Bacon & Thomas

[57] ABSTRACT

A paper clip is made of resilient sheet-steel which is bent into U-shaped structure. Two holes are punched on the upper portion of the U-shaped sheet-steel to define therewith a ridge portion which can be pressed to recess or bent to project over the level surface of the upper portion thereof so as to open the clip for the insertion therein of sheets of paper or close the clip to clamp sheets of paper. Corrugated portions are transversely and longitudinally formed on the upper portion and the lower portion of the clip respectively to reinforce its clamping effect.

1 Claim, 1 Drawing Sheet

FIG. 1
PRIOR ART
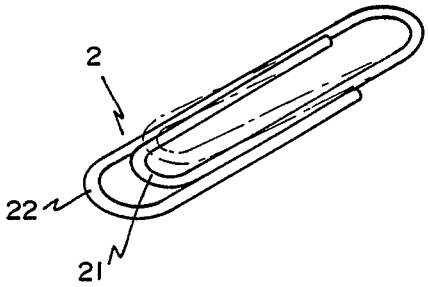
FIG. 2
PRIOR ART
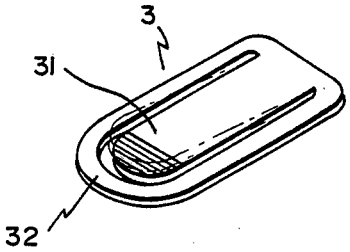
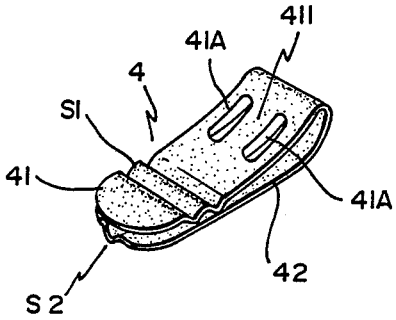
FIG. 3
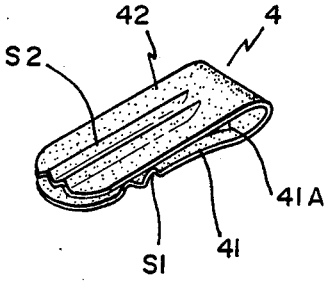
FIG. 3A
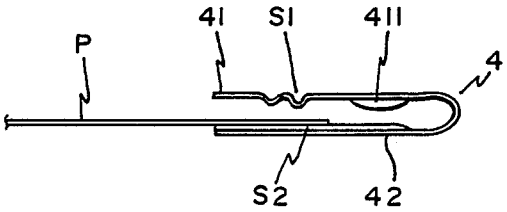
FIG. 3B
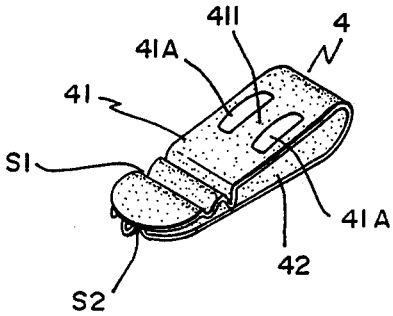
FIG. 4
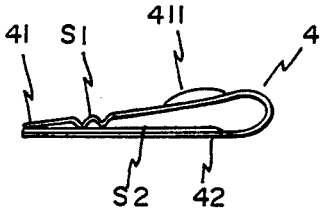
FIG. 4A
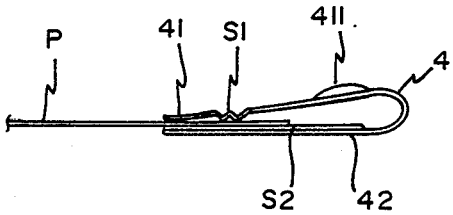
FIG. 4B

RESILIENT SHEET-STEEL PAPER CLIP

BACKGROUND OF THE INVENTION

1. Field of Invention

The present invention is related to a kind of paper clip which is unitarily made of a resilient sheet-steel and formed in U-shaped configuration through press punching process.

2. Description of the Prior Art

Paper clip is a device for clamping sheets of paper together. FIG. 1 illustrates a kind of paper clip which is commonly used at the present day and made of an iron wire through bending process. One disadvantage of this kind of paper clip is its weak clamping force. It can only clamp few sheets of paper at a time. As illustrated, a paper clip 2 of the prior art is comprised of an outer bend portion 22 and an inner bend portion 21. When in use, the inner bend portion 21 is bent upward relative to the outer bend portion 22 to define a ">" shaped retaining space for the insertion therein of sheets of paper. Because the retaining space is substantially in a ">" shape, the clamping force of the clip is stronger at its inner part and weaker at its outer part. Therefore, this kind of paper clip can not efficiently clamp more quantity of sheets of paper. Further, when the inner bend portion 21 and the outer bend portion 22 are bent to deviate from each other, they can not be resiliently turned to close back.

There is another type of clip made of resilient plastic material through punching process. As illustrated in FIG. 2, a plastic clip 3 is comprised of an outer loop portion 32 and an inner tongue portion 31. Similar to the paper clip 2 in FIG. 1, the inner tongue portion 31 and the outer loop portion 32 of the plastic clip 3 define therebetween a contained angle for clamping sheets of paper. The triangular space defined by the contained angle is gradually reduced inward. Therefore, the outer edge between the outer loop portion 32 and the inner tongue portion 31 provides relatively weaker clamping force for clamping sheets of paper, and sheets of paper that are clamped by a plastic clip of the kind may slip away easily.

SUMMARY OF THE INVENTION

An object of the present invention is to provide a resilient sheet-steel paper clip which is simple and inexpensive to manufacture.

Another object of the present invention is to provide a resilient sheet-steel paper clip which has an U-shaped structure comprising an upper portion releasably engaged with a lower portion.

Still another object of the present invention is to provide a resilient sheet-steel paper clip which comprises a ridge portion formed the upper portion thereof through punching process, which ridge portion can be bent to project over the level surface of the upper portion or recess therefrom so as to control the clip to open or close.

A yet further object of the present invention is to provide a resilient sheet-steel paper clip which comprises a transversely corrugated portion on its upper portion and a longitudinally corrugated portion on its lower portion so that the paper clamped is protect from slipping away transversely or longitudinally.

BRIEF DESCRIPTION OF THE DRAWINGS

The foregoing and other objects, features and advantages of the present invention will be best understood from the following description, the appended claims and the accompanying drawings in which:

FIG. 1 illustrates a paper clip according to the prior art;

FIG. 2 illustrates a plastic clip according to the prior art;

FIG. 3 is a perspective view of a resilient sheet-steel paper clip in accordance with the present invention, in which the ridge portion is recessed from the level surface of the upper portion thereof;

FIG. 3A illustrates the back side of the resilient sheet-steel paper clip of FIG. 3;

FIG. 3B is a sectional elevation of the resilient sheet-steel paper clip of FIG. 3 in which, the upper portion is spaced away from the lower portion;

FIG. 4 is a perspective view of the resilient sheet-steel paper clip of FIG. 3, in which the ridge portion is in a projected position, and the upper portion is spaced away from the lower portion;

FIG. 4A is a sectional elevation of the resilient sheet-steel paper clip of FIG. 3, in which the upper portion is engaged with the lower portion; and FIG. 4B is a sectional elevation of the resilient sheet-steel paper clip of FIG. 3, in which a paper is firmly clamped in between the upper portion and the lower portion.

DETAILED DESCRIPTION OF THE PREFERRED EMBODIMENTS

Referring to FIGS. 3 through 4, therein illustrated is a resilient sheet-steel paper clip embodying the present invention, which is made of a resilient sheet steel and bent in an U-shaped configuration. As illustrated, the U-shaped steel sheet 4 includes an upper portion 41 and a lower portion 42. Two elongated slots 41A are longitudinally made on the upper portion 41 through punching process and spaced from each other in parallel to define with the upper portion 41 at a strip-like ridge portion 411 therebetween. Because of the elastic resilient property of the material itself, the ridge portion 411 can be bent to project over the level surface of the upper portion 41 or to recess therefrom. When the ridge portion 411 is recessed from the level surface of the upper portion 41 (see FIGS. 3 and 3B), it can be conveniently pushed to project therefrom (see FIGS. 4, 4A and 4B) by means of inserting a paper P in the clip 4 between the upper portion 41 and the lower portion 42. When the ridge portion 411 is in a projected position, the front end of the upper portion is forced to turn downward to closely contact the front end of the lower portion 42, so that the paper which is inserted therein can be firmly retained; when the ridge portion 411 is in a recessed position, the front end of the upper portion is forced to turn upward to space away from the front end of the lower portion 42 so that the paper which is inserted therein can be removed therefrom.

Referring to FIGS. 3 and 3A again, a transversely corrugated portion S1 vertical to the ridge portion 411 is formed on the upper portion 41 by means of press work, and a longitudinally corrugated portion S2 is simultaneously formed on the lower portion 42 during manufacturing process. Both corrugated portion S1 and S2 can effectively protect a paper which is secured thereto from slipping away transversely or longitudinally.

During operation, the ridge portion 411 of the upper portion 41 of the clip 4 is pressed to recess so that the front end of the upper portion 41 is automatically turned upward to space away from the lower portion 42 for the insertion of paper P in the space between the upper portion 41 and the lower portion 42. As soon as paper P is inserted in the space between the upper portion 41 and the lower portion 42, the front end of the upper portion 41 is pressed downward to turn the ridge portion 411 to project over the level surface of the upper portion 41. As soon as the ridge portion 411 is turned to a projected position over the level surface of the upper portion 41, the front end of the upper portion 41 is firmly forced to bend downward to closely engage with the front end of the lower portion 42, and paper P is firmly retained by the transversely corrugated portion S1 and the longitudinally corrugated portion S2.

I claim:

1. A paper clip made of resilient sheet-steel through punching and press work, having an U-shaped configuration including an upper portion and a lower portion, said upper portion comprising two slots defining therebetween a ridge portion, and a transversely corrugated portion vertical to said ridge portion, said lower portion comprising a longitudinally corrugated portion, wherein said upper portion has its front end spaced away from the front end of said lower portion when said ridge portion is pressed to recess from the level surface of said upper portion, and said upper portion has its front end closely engaged with the front end of said lower portion when said ridge portion is turned to project over the level surface of said upper portion.

* * * * *